US006712245B2

(12) United States Patent
Barrett

(10) Patent No.: US 6,712,245 B2
(45) Date of Patent: Mar. 30, 2004

(54) VENTING PLUNGER FOR CAULK CARTRIDGES

(76) Inventor: Arther Barrett, 330-1 Industrial Park Rd., Harrison, AR (US) 72601

( * ) Notice: Subject to any disclaimer, the term of this patent is extended or adjusted under 35 U.S.C. 154(b) by 0 days.

(21) Appl. No.: 10/442,564

(22) Filed: May 22, 2003

(65) Prior Publication Data

US 2004/0007598 A1 Jan. 15, 2004

Related U.S. Application Data

(60) Provisional application No. 60/395,565, filed on Jul. 15, 2002.

(51) Int. Cl.[7] ..... B67D 5/42
(52) U.S. Cl. ..... 222/386; 222/387
(58) Field of Search ..... 222/386, 387

(56) References Cited

U.S. PATENT DOCUMENTS

| | | | | | |
|---|---|---|---|---|---|
| 4,840,293 | A | * | 6/1989 | Segatz | 222/94 |
| 4,854,485 | A | * | 8/1989 | Collins | 222/386 |
| 5,242,091 | A | * | 9/1993 | Ishida et al. | 222/386 |
| 5,878,922 | A | * | 3/1999 | Boring | 222/387 |
| 6,334,553 | B1 | * | 1/2002 | Bouras et al. | 222/386 |

* cited by examiner

*Primary Examiner*—Philippe Derakshani
(74) *Attorney, Agent, or Firm*—Charles E. Temko

(57) ABSTRACT

A plunger for caulking cartridges, including structure for venting entrapped air between the surface of the caulking composition and the inner surface of the plunger after installation, thereby avoiding the possibility of premature solidification and providing positive plunger action.

2 Claims, 1 Drawing Sheet

VENTING PLUNGER FOR CAULK CARTRIDGES

RELATED APPLICATION

Reference is made to my provisional application, Serial No.: 60/395,565 filed Jul. 15, 2002, now abandoned, to which a claim of priority is made.

BACKGROUND OF THE INVENTION

This invention relates generally to the field of caulking cartridges used for ejecting a caulking composition from a nozzle at a free end thereof, and more particularly to an improved plunger which is mechanically advanced by a lever on a caulking device to propel the caulking material. Devices of this general type are known in the art, and the invention relates to details of structure which provide improved operation.

Devices known in the art include a caulking cartridge which comprises a metallic tube having an ejecting nozzle at one end thereof. The tube is charged at an opposite end of caulking material following which the cartridge is closed by a movable plunger which is incrementally advanced by means on the caulking gun to eject a required amount of material through the nozzle. The initial insertion of the plunger entraps a quantity of air within the tube which must be compressed to transmit motion to the mass of caulking material. However, the air, if not released, tends to cause the upper surface of the caulking material in some areas to harden, making the advancement of the plunger difficult.

This problem has been recognized in the art. One attempted solution is the provision of small longitudinally-oriented grooves on the inner surface of the tube. This will allow atmospheric pressure to enter the tube from the free nozzle end of the cartridge, an undesirable result.

SUMMARY OF THE INVENTION

Briefly stated, the invention contemplates the provision of an improved plunger for use with a caulking tube having air venting means about the periphery thereof which is sufficiently small to permit the passage of air, but prevent the passage of caulking material therepast. This is accomplished by providing small longitudinally-oriented ribs spaced along the periphery having a width of approximately 0.020 inch, and a height of approximately 0.004 inch. Preferably the ribs are in spaced pairs providing a passage therebetween.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
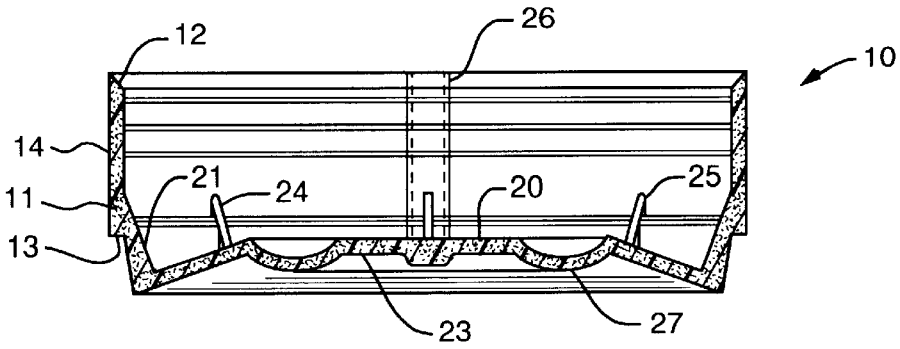
FIG. 1 is a longitudinal section view of an embodiment of the invention.
Figure 2:
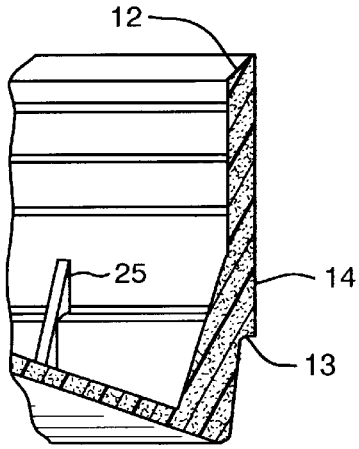
FIG. 2 is a fragmentary enlarged sectional view corresponding to the right hand portion of FIG. 1.
Figure 3:
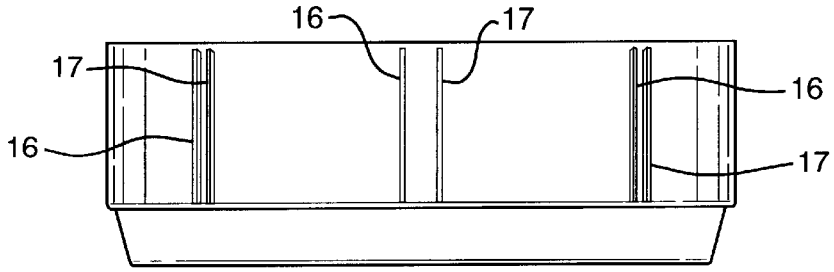
FIG. 3 is a side elevational view thereof.

In accordance with the invention, the device generally indicated by reference character 10, comprises a single molding of synthetic resinous material bounded by a peripheral edge 11, having an upper edge 12 and a lower edge 13. A cylindrical outer surface 14 mounts a plurality of pairs of longitudinal projections 16–17, most conveniently spaced at 120 degree arcuate intervals.

An end wall 20 is of slightly arcuate configuration, including a frusto-conical vertical portion 21 and a horizontal portion 23 having arcuate reinforcing projections 24 and 25. A centrally-disposed sleeve 26 selectively engages with the plunger advancing means on a caulking gun (not shown). An inner surface 27 engages the exposed end surface of caulking material disposed within the caulking tube.

Operation of the plunger will be apparent from a consideration of the drawings. Once inserted within the caulk holding tube (not shown), the end wall, which is of slightly bowed cross section, will tend to move to generally planar condition, thus exerting a radially-outward pressure which is transmitted to the peripheral wall. As the plunger is depressed, any air trapped within the tube will be vented under compression through the interstices formed between each pair of projections 16–17 to the atmosphere. This space is sufficiently narrow that the passage of caulking material will not occur.

Since the end wall is of slightly smaller diameter than that of peripheral wall 11, insertion of the plunger is facilitated, and the entrapped air will be completely vented prior to initial use.

I wish it to be understood that it is not considered that the invention is limited to the practice details illustrated and described, for obvious modifications will occur to those skilled in the art to which the invention pertains.

What is claimed is:

1. An improved plunger for caulking cartridges, comprising a generally cylindrical peripheral wall having an outer surface adapted to engage an inner surface of the tube forming a cartridge, said outer surface having at least one longitudinally-oriented pair of projections extending the axial length of said outer surface and forming a gap for venting of air therepast, said projections each having a width of approximately 0.020 inch, and a height of approximately 0.004 inch whereby said gap will vent compressed air without permitting passage of caulking material as said plunger is advanced against said caulking material.

2. A plunger in accordance with claim 1 including three sets of pairs of projections spaced equally about the periphery of said outer surface of said plunger.

* * * * *